US006583764B2

(12) United States Patent
Ieda et al.

(10) Patent No.: US 6,583,764 B2
(45) Date of Patent: Jun. 24, 2003

(54) LOOP ANTENNA DEVICE

(75) Inventors: Kiyokazu Ieda, Chiryu (JP); Yuichi Murakami, Chiryu (JP); Rikuo Hatano, Toyota (JP); Eiji Mushiaki, Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/080,546

(22) Filed: Feb. 25, 2002

(65) Prior Publication Data

US 2002/0163474 A1 Nov. 7, 2002

(30) Foreign Application Priority Data

Feb. 23, 2001 (JP) ..... 2001-048456

(51) Int. Cl.[7] ..... H01Q 11/12
(52) U.S. Cl. ..... 343/742; 343/867
(58) Field of Search ..... 343/741, 742, 343/713, 866, 867, 787, 788; 455/124, 129

(56) References Cited

U.S. PATENT DOCUMENTS 4,453,269 A * 6/1984 Skar ..... 455/129
5,008,647 A * 4/1991 Brunt et al. ..... 340/432
5,973,650 A * 10/1999 Nakanishi ..... 343/742

FOREIGN PATENT DOCUMENTS

DE 41 05 826 A1 9/1991
JP 2000-261245 A 9/2000

* cited by examiner

*Primary Examiner*—Tan Ho
(74) *Attorney, Agent, or Firm*—Burns, Doane, Swecker & Mathis, LLP

(57) ABSTRACT

To provide a loop antenna device which inhibits the unnecessary radiation of the electric wave and which can increase the sending speed of data placed on the electric wave. The first loop antenna 14 includes the coil L11 and the resonant capacitor C1 and constitutes a series resonant circuit in which the oscillator is connected in series to the coil L11 and the resonant capacitor C1. The second loop antenna 15 includes the coil L2 and the resonant capacitor C2 which are connected each other in parallel and constitutes a parallel resonant circuit. The second loop antenna 15 is magnetically connected to the first loop antenna 14 via the link coil L12. The switching elements 14, 15 are connected to the first and second loop antennas 14, 15 and the damping is performed to the resonant circuits of the antennas 14, 15 when the switching elements 18, 19 become OFF condition by the control signal from the controller 9.

14 Claims, 7 Drawing Sheets

LOOP ANTENNA DEVICE

FIELD OF THE INVENTION

This invention relates to a loop antenna device.

BACKGROUND OF THE INVENTION

A conventional loop antenna device is disclosed in German Patent Publication DE 4105826 or Japanese Patent Laid-Open Publication No. 2000-261245. The former conventional loop antenna device is shown in FIG. 8(*a*) and FIG. 8(*b*). As shown in FIG. 8(*a*) and FIG. 8(*b*), this loop antenna device 51 includes a first antenna 55 and a second antenna 58. The first antenna 55 has a coil 53 wound around a ferrite rod 52 and a resonant capacitor 54 connected to the coil 53 and constitutes a parallel resonant circuit. The second coil 58 has a circular coil 56 magnetically connected to the coil 53 and a resonant capacitor 57 connected to the circular coil 56 and constitutes a parallel resonant circuit.

When a high frequency is fed to a coil 59 wound around the ferrite rod 52 from a power source 60, a magnetic field component is generated by the first antenna 55 in the y-axis direction and a magnetic field component is generated by the second antenna 58 in the z-axis direction. Thereby, a composite magnetic field is generated in the y-z-axis direction and a predetermined electric wave corresponding this composite magnetic field is radiated from the loop antenna device 51 when each resonant circuits of the first and second antennas 55 and 58 resonated.

Furthermore, the latter conventional loop antenna device is shown in FIG. 9. As shown in FIG. 9, in this loop antenna, a request signal output circuit 62 which constitutes a transmitter of an antenna 61 includes a crystal oscillator 63, an oscillating circuit 64, a D-type flip-flop 65, two amplification circuits 66, 67 and a modulation circuit 68. The output terminals of the amplification circuits 66, 67 are connected to magnetic field generating parts (coils) 69, 70 which are disposed while declining with 90 degree each other, respectively. Resonant capacitors 71, 72 are connected to the coils 69, 70, respectively and a resonant circuit is constituted by the coils 69, 70 and the resonant capacitors 71, 72, respectively.

A predetermined pulse signal which is outputted from an output terminal Q1 of the oscillating circuit 64 is fed to the coil 69. A pulse signal whose phase is shifted with 90 degree with respect to the pulse signal from the output terminal Q1 is fed to the coil 70 by the flip-flop 65. Thereby, a composite magnetic field (a rotational magnetic field) which has directional characteristics of 360 degree is generated by the coils 69, 70 and a predetermined electric wave corresponding this composite magnetic field is radiated from the antenna 61 in response to a timing of a control signal outputted from a microcomputer 73.

In the former loop antenna device 51 shown in FIG. 8, however, although the first antenna 55 is disposed inside of the circular coil 56, since empty space is large, the size of the antenna device increases. On the other hand, in the latter conventional antenna 61, the electric wave continues radiated due to a discharge phenomenon of the resonant capacitors 71, 72 after the output of the pulse signal is ended. Namely, as shown a wave form of an antenna output in FIG. 10, the energy stored in the resonant capacitors 71, 72 is discharged for a T interval after the output of the pulse signal is ended and the electric wave from the antenna 61 continues radiated. Accordingly, in case that a next data is sent after a certain data is placed on the electric wave and is sent, it is necessary to set a time margin until the end of the discharge of the resonant capacitors 71, 72. As a result, it is impossible to increase a data sending speed.

In order to overcome the drawback regarding the data sending speed, for example, it is found to be useful that a damping resistance is connected to the resonant circuit. When a damping is performed by the damping resistance, however, the damping is always performed to the resonant circuit independently of with or without the radiation of the electric wave and the extra energy is consumed. Namely, the energy on the resonant circuit is always consumed by the damping resistance. Thereby, an antenna gain or a radiant efficiency which affect a transceiving (receiving and sending) sensitivity of the electric wave decrease and high input has to be given to the resonant circuit for preventing the decrease of the antenna gain or the radiant efficiency.

A first object of the present invention is to provide a loop antenna device which inhibits the unnecessary radiation of the electric wave and which can increase the sending speed of data placed on the electric wave. A second object of the present invention is to provide a loop antenna device which can achieve the first object and which can perform the damping to the resonant circuit without influencing the antenna gain or the radiant efficiency greatly.

SUMMARY OF THE INVENTION

The invention according to one aspect provides a loop antenna device comprising;

a first loop antenna constituting a resonant circuit by a coil and a resonant capacitor and resonating on the basis of a high frequency signal of a resonant frequency intermittently outputted from an oscillation means; a second loop antenna constituting a resonant circuit by a coil and a resonant capacitor and resonating by an inductive electromotive force led by a mutual induction via a link coil when the first antenna resonates; and a damping means for compulsory eliminating a discharge phenomenon of the resonant capacitor when the radiation of an electric wave is completed and connected to at least one of the first loop antenna and the second loop antenna.

When the first loop antenna resonates by the high frequency signal of the resonant frequency, the second loop antenna resonates by the mutual induction via the link coil and an electric wave is radiated from the loop antenna device. When the radiation of the electric wave is completed, the electric charge stored in the resonant capacitor of the resonant circuit is discharged and a discharge phenomenon generates. However, since this stored energy is consumed as a heat energy by the damping means and the discharge phenomenon is compulsory eliminated, the unnecessary radiation of the electric wave is inhibited. Thereby, it is unnecessary to set a time margin until the unnecessary radiation of the electric wave is completed and the sending speed of data placed on the electric wave can be increased.

The damping means is a switching means whose ON-OFF condition is changed by a digital control signal outputted from a control means, and the resonant circuit constitutes a closed circuit when the switching means is in the ON condition on the basis of the control signal, and the discharge phenomenon of the resonant capacitor is compulsory eliminated by the switching means when the switching means is in the OFF condition in response to the change of the level of the control signal.

When the switching means becomes the ON condition on the basis of the control signal outputted from the control means, the resonant circuit constitutes a closed circuit and resonates. When the level of the control signal is changed and the radiation of the electric wave is completed, the switching means becomes the OFF condition and an internal resistance is generated in the switching means. The electric charge stored in the resonant capacitor is consumed at once as a heat energy by the internal resistance. Thereby, the unnecessary radiation of the electric wave is inhibited.

The switching means are provided on both of the first and second loop antennas and are changed between the ON-OFF condition by the same control signal.

The discharge phenomenon generated in both of the resonant capacitors of the first and second loop antennas is compulsorily eliminated and the reliability of the loop antenna device is improved.

The invention according to another aspect provides a loop antenna device comprising; a first loop antenna constituting a resonant circuit by a coil and a resonant capacitor and resonating on the basis of a high frequency signal of a resonant frequency intermittently outputted from an oscillation means; a second loop antenna constituting a resonant circuit by a coil and a resonant capacitor and resonating by an inductive electromotive force led by a mutual induction via a link coil when the first antenna resonates; and a damping means connected to the second loop antenna; wherein a connecting condition of the damping means is changed in response to a timing of a high frequency signal outputted from the oscillation means which is connected to the first loop antenna, and the damping means makes the resonant circuit of the second loop antenna in a connected condition when the high frequency signal is in output condition, and the damping means eliminates compulsory a discharge phenomenon of the resonant capacitor when the high frequency signal is in non-output condition.

When the high frequency signal of the resonant frequency is outputted from the oscillation means, the high frequency signal is outputted to the damping means and the condition of the resonant circuit of the second loop antenna becomes the connecting condition. In this condition, when the resonant circuit of the first loop antenna resonates by the high frequency signal, the second loop antenna resonates by a mutual induction via the link coil and an electric wave is radiated from the loop antenna device. When the high frequency signal is not outputted and the radiation of the electric wave is completed, the electric charge stored in the resonant capacitor of the second loop antenna is discharged and a discharge phenomenon generates. However, since this stored energy is consumed as heat energy by the damping means and the discharge phenomenon is compulsory eliminated, the unnecessary radiation of the electric wave is inhibited. Thereby, it is unnecessary to set a time margin until the unnecessary radiation of the electric wave is completed and the sending speed of data placed on the electric wave can be increased.

The oscillation means has two switching means which are connected in series between an electric power source and a ground, and outputs the high frequency by the changing of the ON-OFF condition of the switching means by a control means, and one of the switching means connected to the ground functions also as the damping means of the first loop antenna.

When the radiation of the electric wave is completed, the electric charge stored in the resonant capacitor of the first loop antenna is discharged and a discharge phenomenon is generated. However, since this stored energy is consumed as heat energy by the damping means and the discharge phenomenon is compulsorily eliminated, unnecessary radiation of the electric wave is inhibited. Thereby, since the discharge phenomenon generated in both of the resonant capacitors of the first and second loop antennas is compulsorily eliminated and the reliability of the loop antenna device is improved. Furthermore, since the switching means of the oscillation means functions also as the damping means which eliminates compulsory the discharge phenomenon of the resonant capacitor of the first loop antenna, it is able to reduce the number of parts of the loop antenna device.

One of the switching means of the first loop antenna makes the resonant circuit of the first loop antenna be a closed circuit when one of the switching means become the ON condition, and one of the switching means of the first loop antenna eliminates compulsorily the discharge phenomenon of the resonant capacitor when one of the switching means become the OFF condition.

When the radiation of the electric wave is completed, the switching means becomes the OFF condition and an internal resistance is generated in the switching means. The electric charge stored in the resonant capacitor is consumed at once as a heat energy by the internal resistance. Thereby, unnecessary radiation of the electric wave is inhibited.

The damping means of the second loop antenna is a switching means whose ON-OFF condition is switched by a control signal converted the high frequency signal, and the resonant circuit of the second loop antenna constitutes a closed circuit when the switching means becomes the ON condition on the basis of the control signal, and the discharge phenomenon of the resonant capacitor is compulsory eliminated by the switching means when the switching means becomes the OFF condition by the change of the level of the control signal.

When the high frequency signal is outputted and the switching means becomes the ON condition, the resonant circuit of the second loop antenna constitutes a closed circuit and resonates. When the level of the control signal is changed and the radiation of the electric wave is completed, the switching means becomes the OFF condition and an internal resistance is generated in the switching means. The electric charge stored in the resonant capacitor of the second loop antenna is consumed at once as heat energy by the internal resistance. Thereby, unnecessary radiation of the electric wave is inhibited.

A signal converting means is also provided for converting the high frequency signal outputted from the oscillator means into a digital control signal which switches the operating condition of the damping means of the second loop antenna and is connected between the damping means of the second loop antenna and the first loop antenna.

The connecting condition of the damping means of the second loop antenna is changed by the control signal converted by the signal converting means.

The signal converting means includes a smoothing means for smoothing the high frequency signal outputted from the oscillator means and a demodulation means for converting the converted signal smoothed by the smoothing means into a control signal for switching the connecting condition of the damping means of the second loop antenna.

The high frequency signal outputted from the oscillation means is smoothed by the smoothing means. The converted signal smoothed by the smoothing means is converted into a control signal for switching the connecting condition of the damping means of the second loop antenna by the demodulation means.

The resonant circuit of the first loop antenna and the resonant circuit of the second loop antenna are constituted by one of the series resonant circuit and the parallel resonant circuit.

The resonant circuit of the first loop antenna and the resonant circuit of the second loop antenna are constituted by one of the series resonant circuit and the parallel resonant circuit.

BRIEF DESCRIPTION OF THE DRAWING FIGURES

FIG. 8(*b*) illustrates an equivalent circuit of the conventional loop antenna device.

DETAILED DESCRIPTION OF THE INVENTION

A first embodiment of a loop antenna device which embodies the present invention and which is equipped on a vehicle such as an automobile and so on is described with reference to FIGS. 1 to 4.

Figure 2:
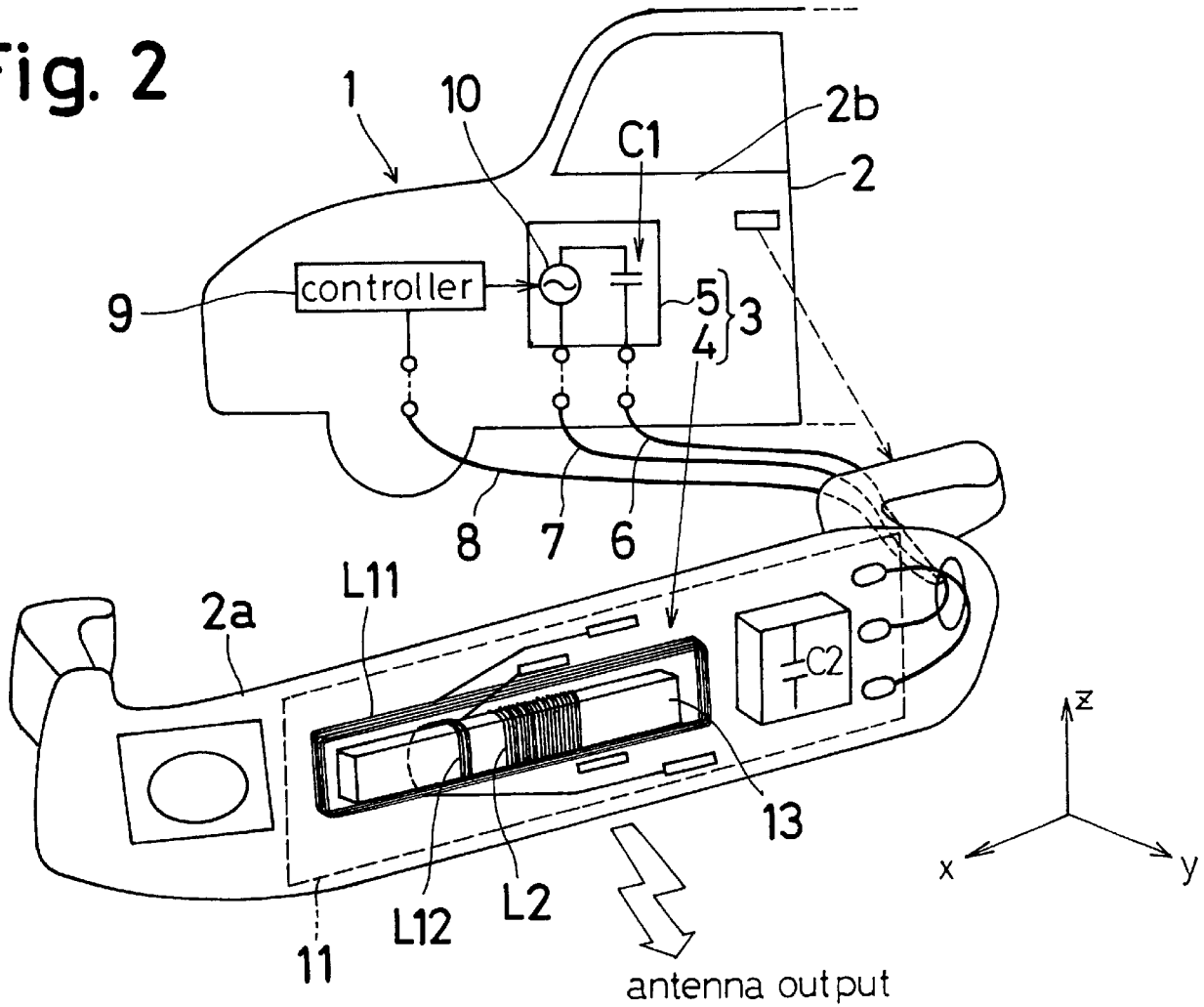
FIG. 2 is a schematic view of the loop antenna device of the first embodiment.

FIG. 2 is a schematic view of the loop antenna device. The loop antenna device 3 which can send an electric wave to a receiver (not shown) carried by a driver and so on (for example, a portable device and so on) is mounted on a door 2 of a vehicle 1. For example, the loop antenna device 3 is applied to a key-less entry device in which an unlock and lock operation is automatically performed when the a person carrying the portable device approaches or leaves a circumference of the vehicle. The loop antenna device 3 includes an antenna circuit 4 housed in a door knob 2*a* and an oscillator device 5 housed in a door main body 2*b*.

The loop antenna device 3 has three signal lines (harness) 6, 7, 8. Two of the signal lines are connected to the oscillator device 5 and the remaining signal line is connected to a controller 9 which is mounted in a vehicle body and which conducts a main control. The oscillator device 5 includes an oscillator 10 and a resonant capacitor C1 and outputs a high-frequency signal having a predetermined wave form shape to an antenna circuit 4. The antenna circuit 4 includes a first coil L11, a link coil L12, a second coil L2 and a resonant capacitor C2, and these components are mounted on a circuit board 11. The controller 9 corresponds to a control means and the oscillator 10 corresponds to an oscillation means.

Figure 3:
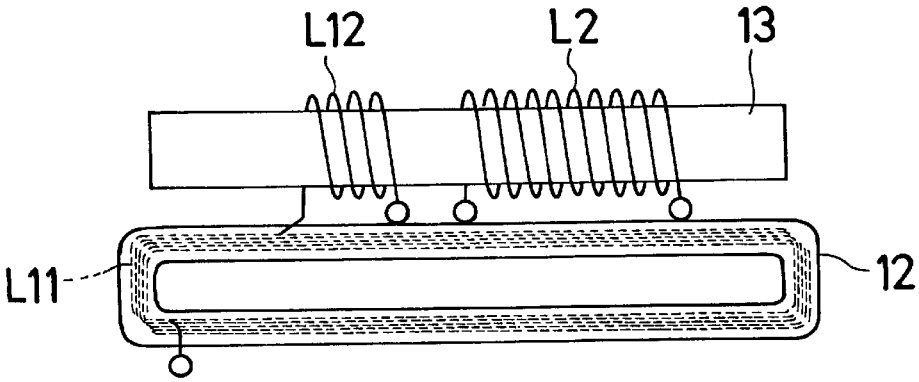
FIG. 3 is an illustration showing how a coil of the first embodiment is wound.

FIG. 3 is a view showing how the coil is wound. As shown in FIGS. 2 and 3, the first coil L11 is wound along an outer circumference of a ferrite bar 13 around a y-axis in FIG. 2 under the condition that the first coil L11 is supported on a bobbin 12 shown in FIG. 3. The second coil L2 is wound along the outer circumference of the ferrite bar 13 around an x-axis in FIG. 2 under the condition that the second coil L2 is located inside of the first coil L11. On the ferrite bar 13, the link coil L12 which is extended from one end of the first coil L11 is wound around the x-axis in FIG. 2 and the second coil L2 is electro-magnetically connected to the first coil L11 by the link coil L12. Namely, when the current is applied to the first coil L11, a mutual induction effect is generated by the link coil L12. As a result, an induced electromotive force is induced in the second coil L2 and the current passes.

Figure 1:
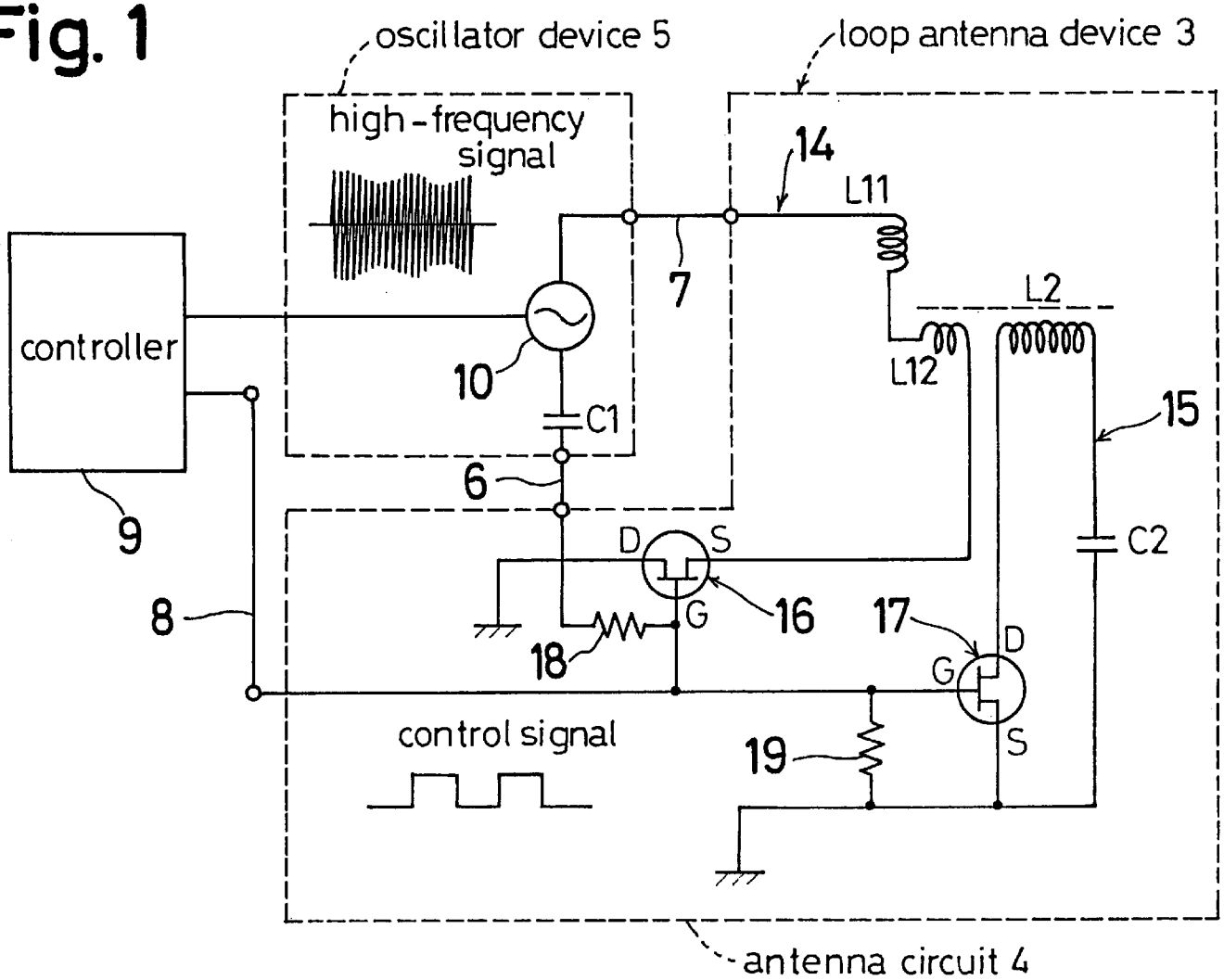
FIG. 1 illustrates an equivalent circuit of a loop antenna device of a first embodiment.

FIG. 1 shows an equivalent circuit of the loop antenna device. A first loop antenna 14 include the first coil L11, the link coil L12, the resonant capacitor C1 and the oscillator 10. These components L11, L12, C1 and 10 are connected in series and constitute a series resonant circuit. When the loop antenna device 3 radiates an electric wave, the oscillator 10 outputs a high-frequency signal shown in FIG. 1 which is modulated by the controller 9 and at this time the first loop antenna 14 resonates in series.

On the other hand, a second loop antenna 15 includes the second coil L2 and the resonant capacitor C2. These components L2 and C2 are connected in parallel and constitute a parallel resonant circuit. Namely, when the high-frequency signal is fed and the current is applied to the link coil L12, an induced electromotive force is generated in the second coil L2 by mutual induction and the second loop antenna 15 resonates in parallel. As described above, when the first loop antenna 14 resonates in series, a magnetic field component is generated in the y-axis direction in FIG. 2. When the second loop antenna 15 resonates, a magnetic field component is generated in the x-axis direction in FIG. 2. Thereby, a predetermined electric wave corresponding to a composite magnetic field in the x-axis direction and the y-axis direction is radiated from the loop antenna device 3.

The resonant capacitor C1 is set to a value in such a manner that the first loop antenna 14 resonates in series by an use-frequency of the oscillator 10. The resonant capacitor C2 is also set to a value in such a manner that the second loop antenna 15 resonates in parallel. Further, a grade between the first and second coil L11 and L2 is changed by the change of winding number of the link coil L12 and is set to a value which is required for radiating the electric wave of the second loop antenna 15. Accordingly, a frequency of the high-frequency signal which the oscillator 10 outputs becomes a resonant frequency.

A switching element 16 for switching the ON-OFF condition of the series resonant circuit constituted by the first loop antenna 14 is connected between the link coil L12 and the resonant capacitor C1. A drain terminal of the switching element 16 is connected to the resonant capacitor C1 and a source terminal thereof is connected to the link coil L12. On the other hand, a switching element 17 for switching the ON-OFF condition of the parallel resonant circuit constituted by the second loop antenna 15 is connected between the second coil L2 and the resonant capacitor C2. A drain terminal of the switching element 17 is connected to the second coil L2 and a source terminal thereof is connected to the resonant capacitor C2. FET, TR, relays and so on are used to these switching elements 16, 17. The switching elements 16, 17 correspond to a damping means and a switching means.

The controller 9 is connected to gate terminals of the switching elements 16, 17 and the switching of the ON-OFF condition of each switching elements 16, 17 is performed by the control signal from the controller 9. Thereby, in the loop antenna 14, 15, when the control signal is the High level, the switching elements 16, 17 are switched to the ON condition and the conditions of the series resonant circuit and the parallel resonant circuit become a connecting condition, respectively. As a result, an electric wave is radiated as an antenna output from the loop antenna device 3. Further, when the control signal is the Low level, the switching elements 16, 17 are switched to the OFF condition and the conditions of the series resonant circuit and the parallel resonant circuit become an interrupted condition. As a result, the radiation of the electric wave from the loop antenna device 3 is ended. Codes and so on for collating with the portable device are placed as data on the electric wave outputted from the loop antenna device 3. Bias resistances 18, 19 are connected in parallel to the switching elements 16, 17, respectively.

Figure 4:
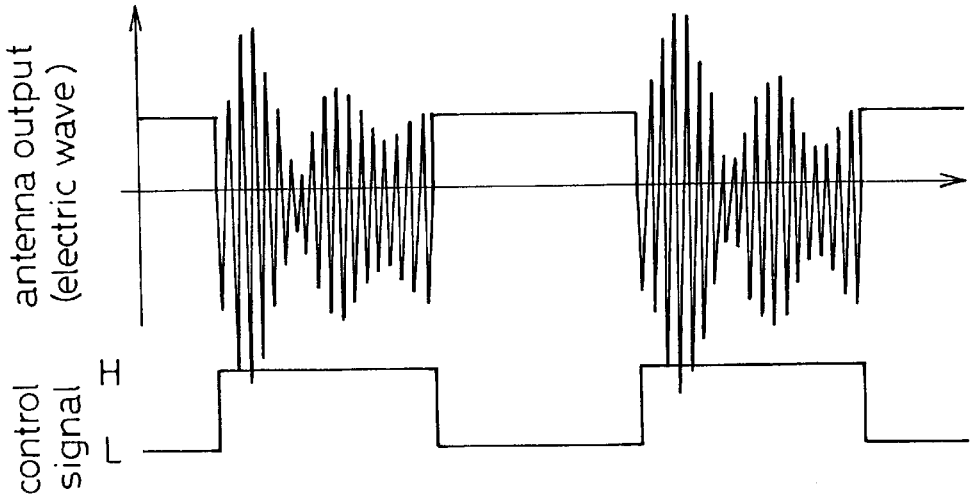
FIG. 4 illustrates the wave form of an antenna output of the loop antenna device of the first embodiment.

Next, the operation of the loop antenna device 3 having the above structures of the first embodiment will be described with reference to FIG. 4. When the control signal outputted from the controller 9 is changed from the Low level to the High level, the switching elements 16, 17 are switched to the ON condition and the conditions of the series resonant circuit of the first loop antenna 14 and the parallel resonant circuit of the second loop antenna 15 become a connecting condition, respectively. At this time, the first loop antenna 14 resonates in series and the second loop antenna 15 resonates in parallel. As a result, an electric wave is radiated from the loop antenna device 3. When the control signal is changed from the High level to Low level, the switching elements 16, 17 are switched to the OFF condition and the conditions of the series resonant circuit of the first loop antenna 14 and the parallel resonant circuit of the second loop antenna 15 become a interrupted condition, respectively.

When the resonant circuits are interrupted, a damping is performed to the loop antenna 14, 15 by the switching elements 16, 17 and the energy stored in the resonant capacitors C1, C2 is consumed at once as heat energy by the switching elements 16, 17. More specifically, when the switching elements 16, 17 are switched to the OFF condition, the energy stored in the resonant capacitors C1, C2 is consumed as heat energy by an impedance generated temporarily at the switching to the OFF condition. Thereby, as shown in FIG. 4, at about the same time as the level of the control signal comes down, the wave form shape (level) of the antenna output also becomes stable and the radiation of the electric wave from the loop antenna device 3 is ended. Accordingly, it is unnecessary to set a time margin until the level of the antenna output becomes stable. Thus, since the next electric wave can be sent just after a certain electric wave of one pulse of the control signal is sent, it is possible to increase a sending speed of a data which is placed on the electric wave.

Here, as mentioned in the description of the prior art, if a damping resistance is simply inserted and a damping is performed, the damping is always performed to the resonant circuit independently with or without the radiation of the electric wave and the extra energy is consumed. In this case, since an antenna gain or a radiant efficiency which affect a transceiving (receiving and sending) sensitivity of the electric wave decrease, high input has to be given to the resonant circuit. In the first embodiment, the switching elements 16, 17 perform the damping for only a split second at the switching to the OFF condition and interrupt the resonant circuits after that. Accordingly, since the damping is performed to each of the resonant circuits of the first and second loop antenna 14, 15 only a split second at the switching to the OFF condition, it is possible to prevent an antenna gain or a radiant efficiency which affect a transceiving (receiving and sending) sensitivity of the electric wave from decreasing.

Accordingly, in the first embodiment, the following effects can be obtained. When the control signal is changed from the High level to the Low level, the loop antenna device 3 completes the radiation of the electric wave at about the same time. Therefore, it is unnecessary to set a time margin until the level of the antenna output becomes stable and it is possible to increase a sending speed of a data which is placed on the electric wave of the loop antenna device 3.

In addition, the switching elements 16, 17 are used for damping the resonant circuits of the first loop antenna 14 and the second loop antenna 15. Thereby, since the damping is performed to each of the resonant circuits for only a split second at the switching of the switching elements 16, 17 to the OFF condition, it is possible to prevent an antenna gain or a radiant efficiency from decreasing.

Next, a second embodiment is described with reference to FIGS. 5 to 7. In the second embodiment, a circuitry of a loop antenna device is different from that of the first embodiment. In the second embodiment, the same or similar parts as compared with the first embodiment are identified by the same reference numerals. Thereinafter, the detailed description of the same or similar parts are omitted and the different parts are described in detail.

Figure 6:
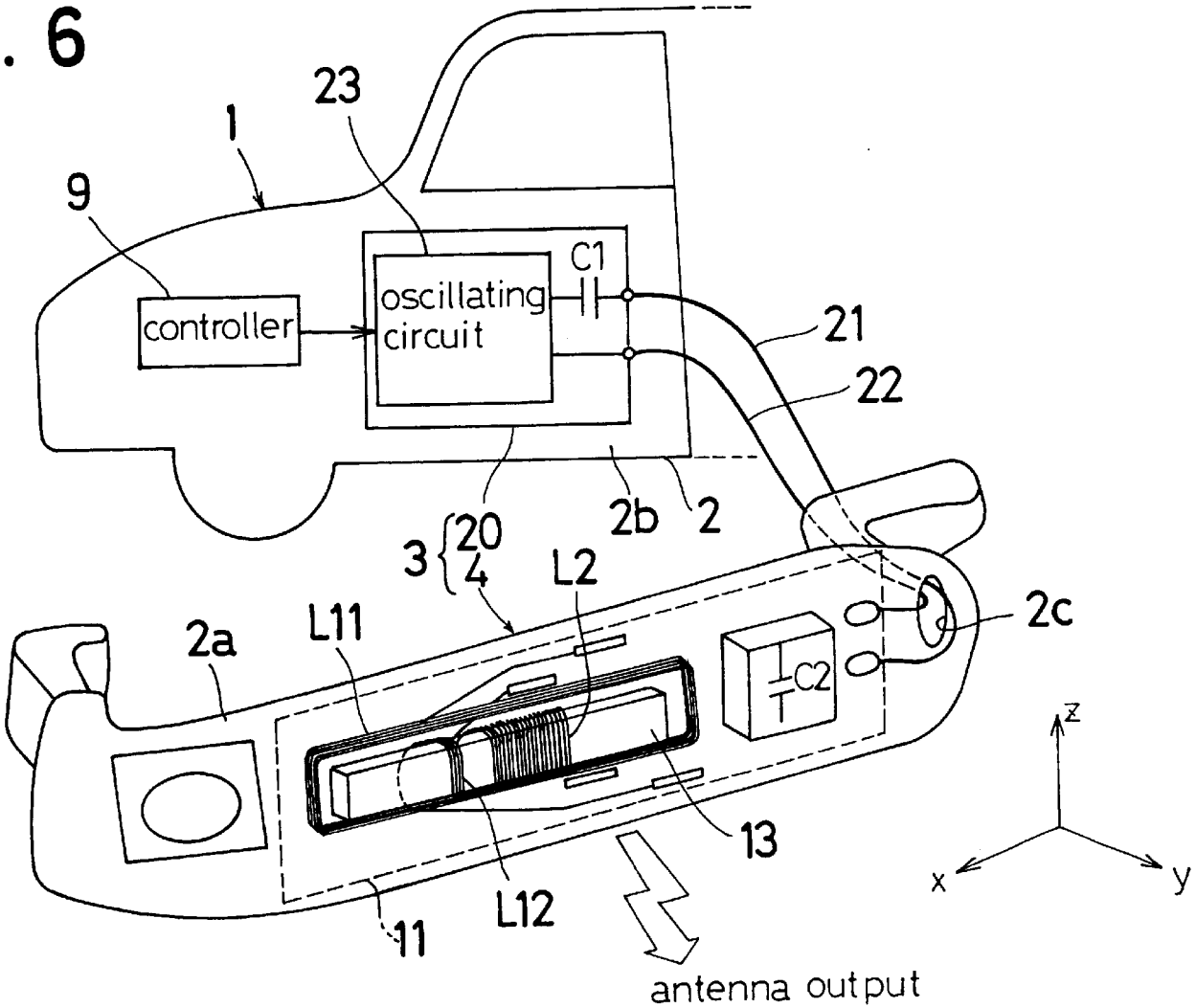
FIG. 6 is a schematic view of the loop antenna device of the second embodiment.

FIG. 6 is a schematic view of the loop antenna device. A loop antenna device 3 which can send an electric wave to a receiver (not shown) carried by a driver and so on (for example, a portable device and so on) is mounted on a door 2 of a vehicle 1. For example, the loop antenna device 3 of the second embodiment is also applied to a key-less entry device. The loop antenna device 3 includes an antenna circuit 4 housed in a door knob 2*a* and an oscillator device 20 housed in a door main body 2*b*.

The loop antenna device 3 has two signal lines (harness) 21, 22 which are connected to the oscillator device 20. The oscillator device 20 includes an oscillating circuit 23 and a resonant capacitor C1, and outputs a high-frequency signal having a predetermined wave form shape to an antenna circuit 4. The high-frequency signal is modulated by the control of the oscillating circuit 23 by means of a controller 9 mounted on the vehicle. The antenna circuit 4 includes a first coil L11, a link coil L12, a second coil L2 and a resonant capacitor C2, and these components are mounted on a circuit board 11.

Figure 5:
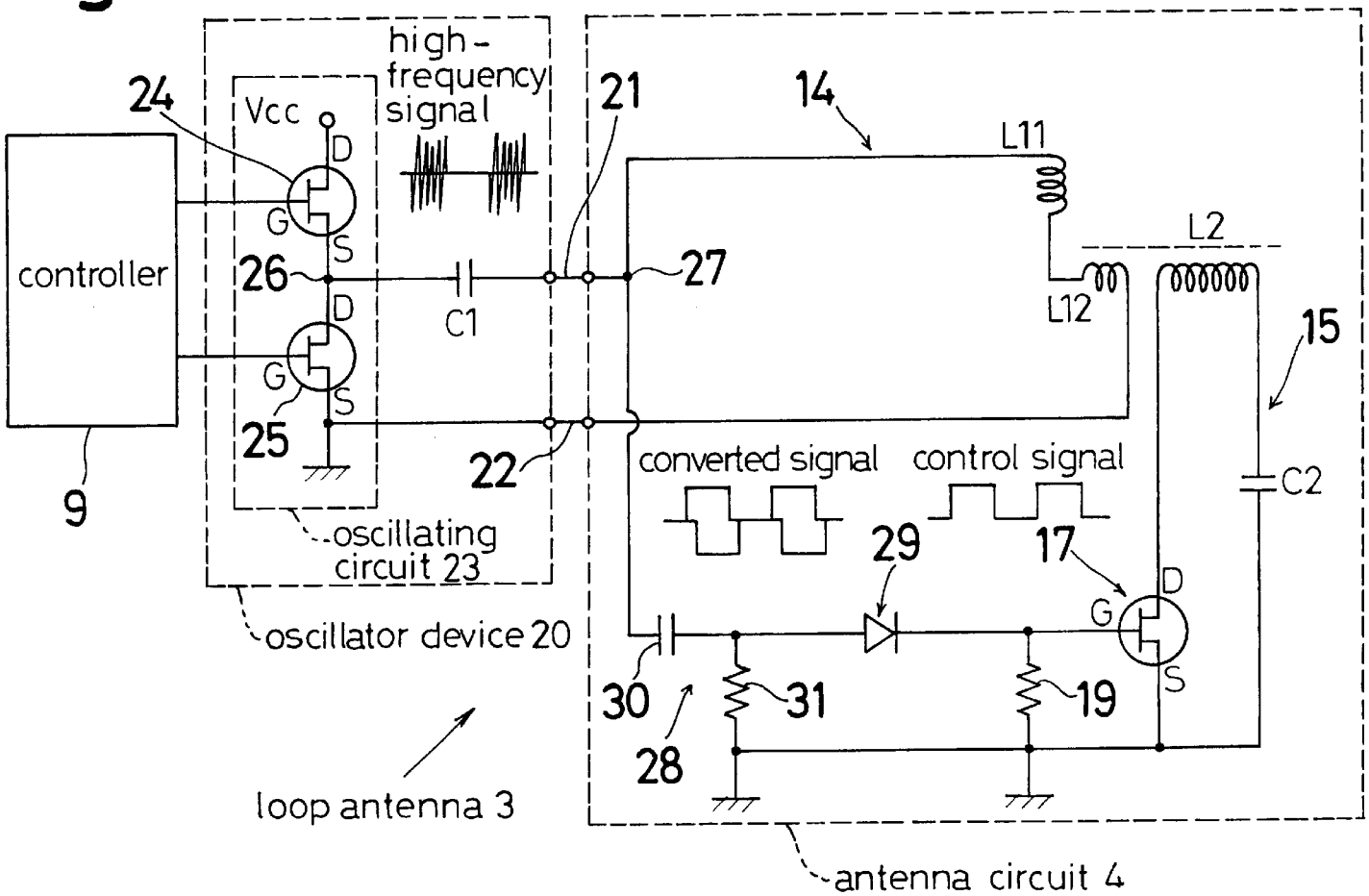
FIG. 5 illustrates an equivalent circuit of a loop antenna device of a second embodiment.

FIG. 5 shows an equivalent circuit of the loop antenna device. A first loop antenna 14 include the first coil L11, the link coil L12, the resonant capacitor C1 and the oscillating circuit 23. These components L11, L12, C1 and 23 are connected in series and constitute a series resonant circuit. The oscillating circuit 23 includes two switching elements 24, 25 connected in series. A source terminal of the switching element 24 located at the upper side in FIG. 5 is connected to a drain terminal of the switching element 25 located at the lower side. A drain terminal of the switching element 24 is connected to an electric power source Vcc and a source terminal of the switching terminal 25 is connected to a ground GND. FET, TR, relays and so on are used to these switching elements 24, 25. The switching elements 24, 25 correspond to switching means and the switching element 25 functions also as a damping means. The oscillating circuit 23 corresponds to an oscillation means.

The resonant capacitor C1 is connected to a central point between the switching elements 24, 25. One end of the link coil 12 is connected to the GND. The gate terminals of the switching elements 24, 25 are connected to the controller 9 and the ON-OFF conditions of the switching elements 24, 25 are switched with a predetermined timing by the controller 9. Thereby, the oscillating circuit 23 intermittently outputs the predetermined high-frequency signal modulated as shown in FIG. 5 with a constant interval and at this time the first loop antenna 14 resonates in series. Further, the switching elements 24, 25 function also as a switch for switching the ON-OFF condition of the series resonant circuit of the first loop antenna. When the switching elements 24, 25 are switched to the OFF conditions, the series resonant circuit becomes an interrupted condition.

On the other hand, a second loop 15 includes the second coil L2 and the resonant capacitor C2. These components L2 and C2 are connected in parallel and constitute a parallel resonant circuit. Namely, when the oscillating circuit 23 is driven and the current is applied to the link coil L12, an induced electromotive force is generated in the second coil L2 by mutual induction and the second loop antenna 15 resonates in parallel. As described above, when the first loop antenna 14 resonates in series, a magnetic field component is generated in the y-axis direction in FIG. 5. When the second loop antenna 15 resonates, a magnetic field component generates in the x-axis direction in FIG. 5. Thereby, a predetermined electric wave corresponding to a composite magnetic field in the x-axis direction and the y-axis direction is radiated from the loop antenna device 3.

A switching element 17 for switching a connecting condition of the parallel resonant circuit of the second loop antenna 15 is connected between the second coil L2 and the resonant capacitor C2. Between the switching element 17 and a central point 27 between the resonant capacitor C1 and the first coil L11, a smoothing circuit 28 and a demodulation circuit 29 are connected starting from the side of the resonant capacitor C1. The smoothing circuit 28 includes a condenser 30 and a resistance 31. The smoothing circuit 28 smoothes the high-frequency signal outputted from the oscillating circuit 23 and then converts into a converted signal which has pulse waves at both sides as shown in FIG. 5. The smoothing circuit 28 corresponds to a signal converting means and a smoothing means, and the demodulation circuit 29 corresponds to the signal converting means and a demodulation means.

The demodulation circuit 29 includes a diode. A cathode terminal of the diode is connected to the gate terminal of the switching element 17 and an anode terminal thereof is connected to the smoothing circuit 28. The demodulation circuit 29 eliminates the one sided pulse wave of the converted signal outputted from the smoothing circuit 28 and outputs to the switching element 17 as a control signal as shown in FIG. 5. Thereby, in the second loop antenna 15, when the control signal is the High level, the switching element 17 is switched to the ON condition and the condition of the resonant circuit becomes a connecting condition. Further, when the control signal is the Low level, the switching element 17 is switched to the OFF condition and the condition of the resonant circuit becomes an interrupted condition. As a result, the loop antenna device 3 radiates an electric wave as an antenna output when the high-frequency signal is outputted from the resonant circuit 23 and the loop antenna device 3 ends the radiation of the electric wave when the high-frequency signal is not outputted.

Next, the operation of the loop antenna device 3 having the above structures of the second embodiment will be described with reference to FIG. 7. When the ON-OFF conditions of the oscillating circuit 23 are switched by the controller 9, the high-frequency signal shown in FIG. 5 is intermittently outputted. When the high-frequency signal is outputted, the conditions of the series resonant circuit of the first loop antenna 14 and the parallel resonant circuit of the second loop antenna 15 become the connecting condition, respectively. At this time, the first loop antenna 14 resonates in series. Further, an induced electromotive force is induced and the second loop antenna 15 resonates in parallel. Thereby, the electric wave is radiated from the loop antenna device 3.

Figure 7:
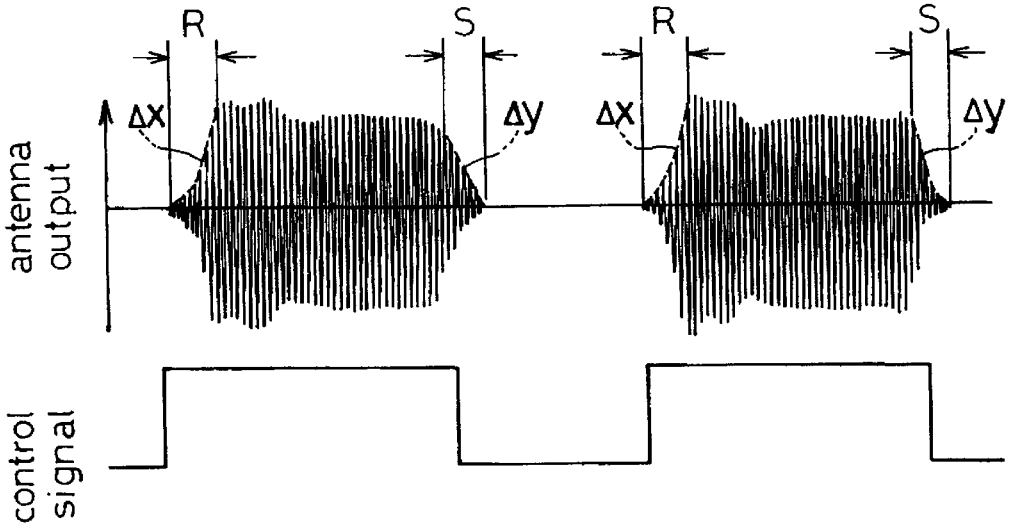
FIG. 7 illustrates the wave form of an antenna output of the loop antenna device of the first embodiment.
Figure 8A:
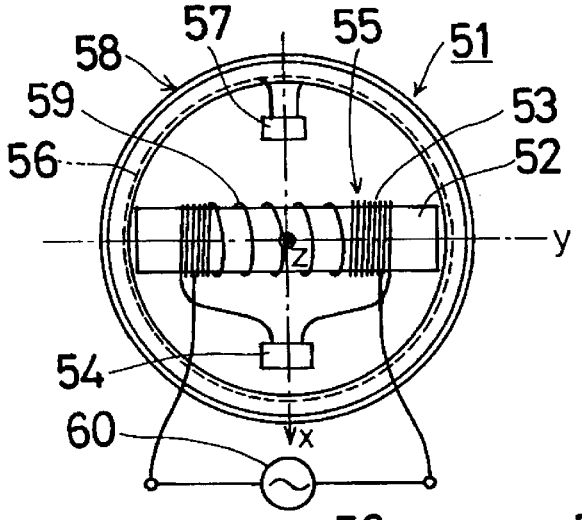
Fig. 8(a) Prior Art
FIG. 8(*a*) is an illustration showing how the coil of the conventional loop antenna is wound.
Figure 8B:
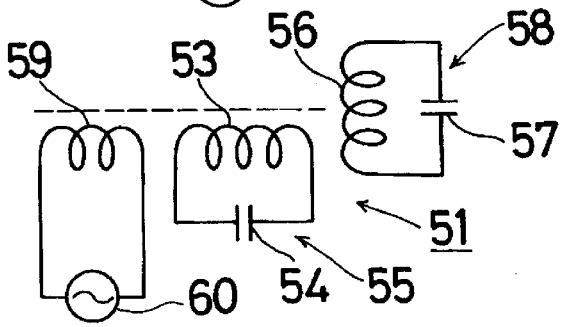
Fig. 8(b) Prior Art
Figure 9:
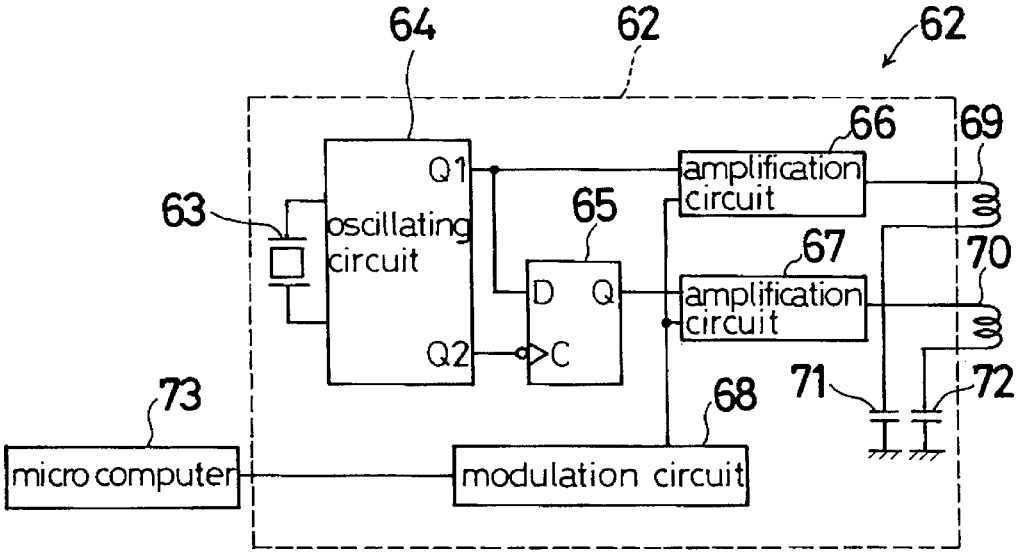
Fig. 9 Prior Art
FIG. 9 is a block diagram of another conventional loop antenna device.
Figure 10:
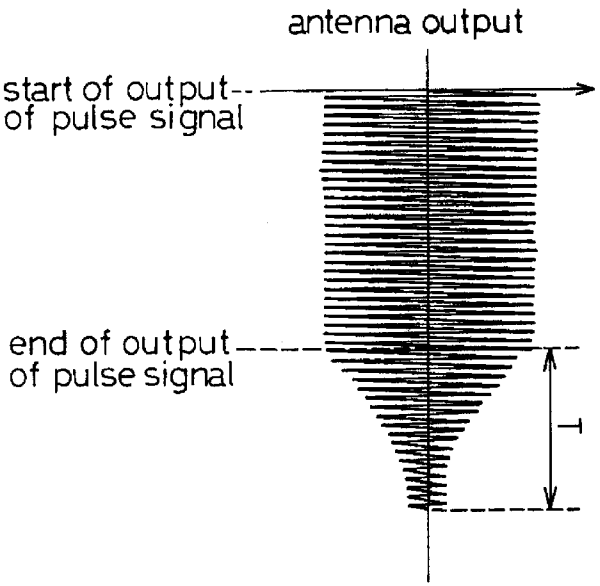
FIG. 10 is an illustration showing a wave form of an antenna output.

In the connecting conditions of the resonant circuits, as shown in FIG. 7, a transient phenomenon is generated at a R interval after the control signal is switched from the L level to the H level and a predetermined gradient $\Delta x$ is generated in the antenna output when the transient phenomenon is generated. Namely, since the switching elements 17, 25 changes gradually from high impedance to low impedance following the gradient $\Delta x$, signals are gradually supplied to each of the resonant circuits. Thereby, an overshoot which is a wave form change until the stability of the level after the antenna output was arisen becomes smaller. As a result, a bit error becomes hard to generate in a sending data placed on the electric wave and an erroneous data becomes hard to be outputted from the loop antenna device 3.

On the other hand, when output of the high-frequency signal is intermitted, the switching elements 24, 25 become the OFF conditions and the series resonant circuit of the first loop antenna 14 becomes the interrupted condition. At this time, the control signal with the L level is supplied to the switching element 17 of the second loop antenna 15. Thereby, the switching element 17 becomes the OFF condition and the parallel resonant circuit of the second loop antenna 15 becomes the interrupted condition. In the interrupted condition of the resonant circuit, as shown in FIG. 7, a transient phenomenon is generated at a S interval after the control signal is switched from the H level to the L level, and a predetermined gradient $\Delta y$ is generated in the antenna output when the transient phenomenon is generated.

Namely, a damping is performed by an internal impedance of each of the switching elements 17, 25 which changes from the H level to the L level following the gradient $\Delta y$, and the energy stored in the resonant capacitors C1, C2 is consumed as heat energy at once by the switching elements 17, 25. Thereby, as shown in FIG. 7, at about the same as the control signal is switched from the H level to the L level, the antenna output becomes stable and the radiation of the electric wave from the loop antenna device 3 is ended. Accordingly, it is unnecessary to set a time margin until the level of the antenna output becomes stable. Thus, since the next electric wave can be sent just after a certain electric wave of one pulse of the control signal is sent, it is possible to increase a sending speed of a data which is placed on the electric wave.

Further, the loop antenna device 3 of the second embodiment has the switching element 25 of the oscillating circuit 23 in common as a switching element for performing a damping of the series resonant circuit of the first loop antenna 14. Accordingly, the switching element on the antenna circuit 4 is only the switching element 17 of the parallel resonant circuit of the second loop antenna 15 and so it is possible to reduce the number of parts.

Further, in the second embodiment, the high-frequency signal intermittently outputted by the oscillating circuit 23 is processed by the smoothing circuit 28 and the demodulation circuit 29, and is converted to the control signal for switching the ON-OFF condition of the switching element 17 of the second loop antenna 15. Thereby, one of the signal lines which is required for receiving the control signal from the controller 9 in the first embodiment is eliminated and the antenna circuit 4 is connected to the oscillator device 20 through two signal lines 21, 22. As a result, even if a diameter of a communicating passage 2*c* (see FIG. 6) which is formed on the door knob 2*a* for passing the signal lines is relatively small, it is possible to connect between the antenna circuit 4 and the oscillator device 20 through the signal lines. Now, in the second embodiment, it is possible to obtain the same effect as the first embodiment.

In the second embodiment, the above mentioned effects of the first embodiment can be obtained. Further, the following additional effects can be obtained in the second embodiment. The impedance of the switching elements 17, 25 changes gradually from high to low following the gradient Δx at the transient phenomenon after the control signal is changed from the High level to the Low level. Thereby, since an overshoot of the antenna output becomes smaller, a bit error becomes hard to generate in a sending data placed on the electric wave and an erroneous data becomes hard to be outputted from the loop antenna device 3.

Also, the damping is performed to the series resonant circuit of the first loop antenna 14 by the switching element of the oscillating circuit 23. Accordingly, the switching element on the antenna circuit 4 is only the switching element 17 of the parallel resonant circuit of the second loop antenna 15 and it is possible to reduce the number of parts.

Further, the antenna circuit 4 is connected to the oscillator device 20 through two signal lines 21, 22. Therefore, even if a diameter of a communicating passage 2*c* which is formed on the door knob 2*a* for passing the signal lines is relatively small, it is possible to connect between the antenna circuit 4 and the oscillator device 20 through the signal lines.

The embodiment is not limited to the above first and second embodiments. For example, it is possible to change to following embodiments.

In the above mentioned first and second embodiments, the loop antenna device of the present invention is not limited to a loop antenna device in which the magnetic field compositions are generated in a two-axis direction by the coil. For example, a third loop antenna which generates a magnetic field composition in the direction perpendicular to the first and second loop antennas may be provided. In this case, the electric wave strength can be improved.

In the first embodiment, the loop antenna device of the present invention is not limited to a loop antenna device in which the damping is performed to the first and the second loop antennas. For example, it is possible to omit the switching element 16 which is positioned at the side of the first loop antenna 14.

In the first and second embodiments, the damping means is not limited to a switching means whose ON-OFF condition is switched on the basis of the digital control signal. For example, although the antenna gain or the radiant efficiency of the loop antenna 3 decreases, it is possible to use a damping resistance.

Further, in the first and second embodiments, the switching means is not limited to FET, TR and so on. It is possible to use everything to be switched to the ON-OFF condition by the digital control signal.

Further, in the second embodiment, the switching element 17 may be connected to the controller 9 and the condition thereof may be switched on the basis of the control signal outputted from the controller 9.

Further, the loop antenna device may be applied to an apparatus for home use and so on.

The following additional technical ideas in accordance with the present invention can be understood by the above mentioned embodiments and the modifications thereof.

The coil of the first loop antenna and the coil of the second loop antenna are disposed so that the directions of the magnetic field compositions generated by each of the coils intersect each other with about 90 degrees. In addition, the second loop antenna includes a couple of the coil and the resonant capacitor and the magnetic field compositions extending in the two axis directions are generated by the coil of the first loop antenna and the coil of the second loop antenna. Also, the loop antenna device is mounted on a door of a vehicle.

According to the present invention, since the discharge phenomenon of the resonant capacitor due to the resonance function is compulsorily eliminated by the damping means, the unnecessary radiation of the electric wave is inhibited and the sending speed of data placed on the electric wave can be increased.

What is claimed is:

1. A loop antenna device comprising:

a first loop antenna constituting a resonant circuit that includes a coil and a resonant capacitor and that resonates based on a high frequency signal of a resonant frequency intermittently outputted from an oscillation means;

a second loop antenna constituting a resonant circuit that includes a coil and a resonant capacitor and that resonates by an inductive electromotive force led by a mutual induction via a link coil when the first loop antenna resonates; and damping means for compulsorily eliminating a discharge phenomenon of the resonant capacitor when radiation of an electric wave is completed and connected to at least one of the first loop antenna and the second loop antenna.

2. A loop antenna device according to claim 1, wherein the damping means is a switching means changed between ON-OFF conditions by a digital control signal outputted from a control means, and the resonant circuit constitutes a closed circuit when the switching means is in the ON condition on the basis of the control signal, and the discharge phenomenon of the resonant capacitor is compulsorily eliminated by the switching means when the switching means is in the OFF condition in response to a change of a level of the control signal.

3. A loop antenna device according to claim 2, wherein the switching means are provided on both of the first and second loop antennas and are changed between the ON-OFF condition by a same control signal.

4. A loop antenna device according to claim 1, wherein the resonant circuit of the first loop antenna and the resonant circuit of the second loop antenna are constituted by one of a series resonant circuit and a parallel resonant circuit.

5. A loop antenna device comprising:

a first loop antenna constituting a resonant circuit that includes a coil and a resonant capacitor and that resonates based on a high frequency signal of a resonant frequency intermittently outputted from an oscillation means;

a second loop antenna constituting a resonant circuit that includes a coil and a resonant capacitor and that resonates by an inductive electromotive force led by a mutual induction via a link coil when the first antenna resonates; and damping means connected to the second loop antenna;

wherein a connecting condition of the damping means is changed in response to a timing of a high frequency signal outputted from the oscillation means which is connected to the first loop antenna, and the damping means causes a connected condition of the resonant circuit of the second loop antenna when the high frequency signal is in an output condition, and the damping means compulsorily eliminates a discharge phenomenon of the resonant capacitor when the high frequency signal is in a non-output condition.

6. A loop antenna device according to claim 5, wherein the oscillation means has two switching means which are connected in series between an electric power source and a ground and outputs the high frequency by changing an ON-OFF condition of the switching means by a control means, and one of the switching means connected to the ground functions also as the damping means of the second loop antenna.

7. A loop antenna device according to claim 6, wherein one of the switching means of the first loop antenna makes the resonant circuit of the first loop antenna be a closed circuit when one of the switching means becomes the ON condition, and one of the switching means of the first loop antenna compulsorily eliminates the discharge phenomenon of the resonant capacitor when one of the switching means become the OFF condition.

8. A loop antenna device according to claim 7, wherein the damping means of the second loop antenna is a switching means whose ON-OFF condition is switched by a control signal converted from the high frequency signal, and the resonant circuit of the second loop antenna constitutes a closed circuit when the switching means becomes the ON condition on the basis of the control signal, and the discharge phenomenon of the resonant capacitor is compulsorily eliminated by the switching means when the switching means becomes the OFF condition by a change in a level of the control signal.

9. A loop antenna device according to claim 5, wherein the damping means of the second loop antenna is a switching means whose ON-OFF condition is switched by a control signal converted from the high frequency signal, and the resonant circuit of the second loop antenna constitutes a closed circuit when the switching means becomes the ON condition on the basis of the control signal, and the discharge phenomenon of the resonant capacitor is compulsorily eliminated by the switching means when the switching means becomes the OFF condition by a change in a level of the control signal.

10. A loop antenna device according to claim 9, comprising signal converting means for converting the high frequency signal outputted from the oscillator means into a digital control signal which switches an operating condition of the damping means of the second loop antenna, the signal converting means being connected between the damping means of the second loop antenna and the first loop antenna.

11. A loop antenna device according to claim 5, further comprising signal converting means for converting the high frequency signal outputted from the oscillator means into a digital control signal which switches an operating condition of the damping means of the second loop antenna, the signal converting means being connected between the damping means of the second loop antenna and the first loop antenna.

12. A loop antenna device according to claim 11, wherein the signal converting means includes smoothing means for smoothing the high frequency signal outputted from the oscillator means and demodulation means for converting the signal smoothed by the smoothing means into a control signal for switching the connecting condition of the damping means of the second loop antenna.

13. A loop antenna device according to claim 12, wherein the resonant circuit of the first loop antenna and the resonant circuit of the second loop antenna are constituted by one of a series resonant circuit and a parallel resonant circuit.

14. A loop antenna device according to claim 5, wherein the resonant circuit of the first loop antenna and the resonant circuit of the second loop antenna are constituted by one of a series resonant circuit and a parallel resonant circuit.

* * * * *